US008025289B2

(12) United States Patent
Hirai

(10) Patent No.: US 8,025,289 B2
(45) Date of Patent: Sep. 27, 2011

(54) RECORDING APPARATUS PERFORMING SKEW CORRECTION

(75) Inventor: Yasuyuki Hirai, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 261 days.

(21) Appl. No.: 12/426,480

(22) Filed: Apr. 20, 2009

(65) Prior Publication Data

US 2009/0278301 A1 Nov. 12, 2009

(30) Foreign Application Priority Data

May 8, 2008 (JP) ..... 2008-122393

(51) Int. Cl.
*B65H 9/04* (2006.01)

(52) U.S. Cl. ..... 271/242; 271/275

(58) Field of Classification Search ..... 271/242, 271/275, 244; 347/104; 399/303
See application file for complete search history.

(56) References Cited

U.S. PATENT DOCUMENTS 5,176,374 A 1/1993 Yamada
5,531,436 A * 7/1996 Ohyama et al. ..... 271/275
5,568,244 A * 10/1996 Hirai et al. ..... 399/382
6,079,814 A 6/2000 Lean et al.
2005/0168515 A1* 8/2005 Nagai et al. ..... 347/23
2006/0263113 A1* 11/2006 Matsumoto ..... 399/164

FOREIGN PATENT DOCUMENTS

JP 04-085230 A 3/1992
JP 2000-143026 A 5/2000
JP 2006-321571 A 11/2006

* cited by examiner

*Primary Examiner* — Jeremy R Severson

(74) *Attorney, Agent, or Firm* — Fitzpatrick, Cella, Harper & Scinto

(57) ABSTRACT

A recording apparatus is capable of reliably correcting skew feeding of a recording sheet in an arrangement for conveying the recording sheet absorbed by a belt surface. The recording apparatus includes: a driving roller for driving the conveying belt wound around the driving roller and electrically charging the conveying belt by application of a voltage; and a pinching roller abutting against the driving roller via the conveying belt. A pinching section, which is formed by the driving roller and the pinching roller, corrects skew feeding of the recording sheet fed from the paper feed section and thereafter the voltage is applied to the driving roller to electrically charge the conveying belt.

14 Claims, 11 Drawing Sheets

RECORDING APPARATUS PERFORMING SKEW CORRECTION

BACKGROUND OF THE INVENTION

1. Field of the Invention

The present invention relates to a recording apparatus having a conveying belt which absorbs a recording sheet fed by a paper feed section to record on the recording sheet absorbed by the conveying belt.

2. Related Background Art

Conventionally, in a recording apparatus which conveys a recording sheet by driving a belt that absorbs the recording sheet onto the belt surface by static electricity, a power feed roller abutting against the belt surface has generated electric charges on the belt surface.

Japanese Patent Application Laid-Open No. 2000-143026 discloses an arrangement for generating electric charges on a belt by applying a voltage to a driving roller which drives the belt, as an arrangement without the use of a power feed roller.

Meanwhile, the recording apparatus is required to correct skew feeding of a recording sheet before conveying the recording sheet to an area opposite to a recording head in order to prevent the recording sheet from being conveyed in an inclined condition when the recording head starts a recording operation. In a recording apparatus having a belt conveying section which conveys the recording sheet absorbed on the belt surface, a paper feed section has been provided with a guide member for aligning both widthwise edges of the recording sheet in order to prevent an occurrence of skew feeding in a paper feed stage. Moreover, in another arrangement, a registration roller pair has been provided to correct skew feeding of the recording sheet upstream from the belt conveying section.

In recent years, the recording apparatus has been required to support recording sheets of various sizes such as business card, A4, A3, rolled letter paper, and other sizes. In the above-described arrangement in which the paper feed section is provided with the guide member for aligning both widthwise edges of the recording sheet, the guide member is effective to reduce the occurrence of skew feeding, in the case of feeding a large-sized recording sheet, due to the long dimension of the recording sheet guided by the guide member. On the other hand, in the case of feeding a small-sized recording sheet, the guide member is ineffective to prevent the occurrence of skew feeding because the recording sheet comes off the guide member when the recording sheet is conveyed to the belt conveying section due to the short dimension of the recording sheet guided by the guide member. Moreover, the arrangement provided with the foregoing registration roller pair has a problem that the provision increases the number of parts and the size of apparatus.

SUMMARY OF THE INVENTION

In view of the above problems, an object of the present invention is to provide a recording apparatus capable of reliably correcting skew feeding of a recording sheet in an arrangement for conveying the recording sheet absorbed by a belt surface.

To achieve the above object, according to an aspect of the present invention, a recording apparatus is provided which includes a paper feed section for feeding a recording sheet; a conveying belt for absorbing and conveying the recording sheet; a driving roller for driving the conveying belt wound around the driving roller and electrically charging the conveying belt by application of a voltage; and a pinching roller abutting against the driving roller via the conveying belt, wherein the recording apparatus performs recording on the recording sheet absorbed by the conveying belt and wherein a pinching section, which is formed by the driving roller and the pinching roller, corrects skew feeding of the recording sheet fed from the paper feed section and thereafter the voltage is applied to the driving roller to electrically charge the conveying belt.

Further, according to another aspect of the present invention, a recording apparatus is provided which includes a paper feed section for feeding a recording sheet; a conveying belt for absorbing and conveying the recording sheet; a driving roller for driving the conveying belt wound around the driving roller; and a pinching roller abutting against the driving roller via the conveying belt and electrically charging the conveying belt by application of a voltage, wherein the recording apparatus performs recording on the recording sheet absorbed by the conveying belt and wherein a pinching section, which is formed by the driving roller and the pinching roller, corrects skew feeding of the recording sheet fed from the paper feed section and thereafter the voltage is applied to the pinching roller to electrically charge the conveying belt.

According to the present invention, a recording apparatus is provided which is capable of reliably correcting skew feeding of a recording sheet in an arrangement for conveying the recording sheet absorbed by a belt surface.

Further features of the present invention will become apparent from the following description of exemplary embodiments with reference to the attached drawings.

DETAILED DESCRIPTION OF THE EMBODIMENTS

An embodiment of the present invention will be described in detail below with reference to accompanying drawings.

First Embodiment

Figure 1:
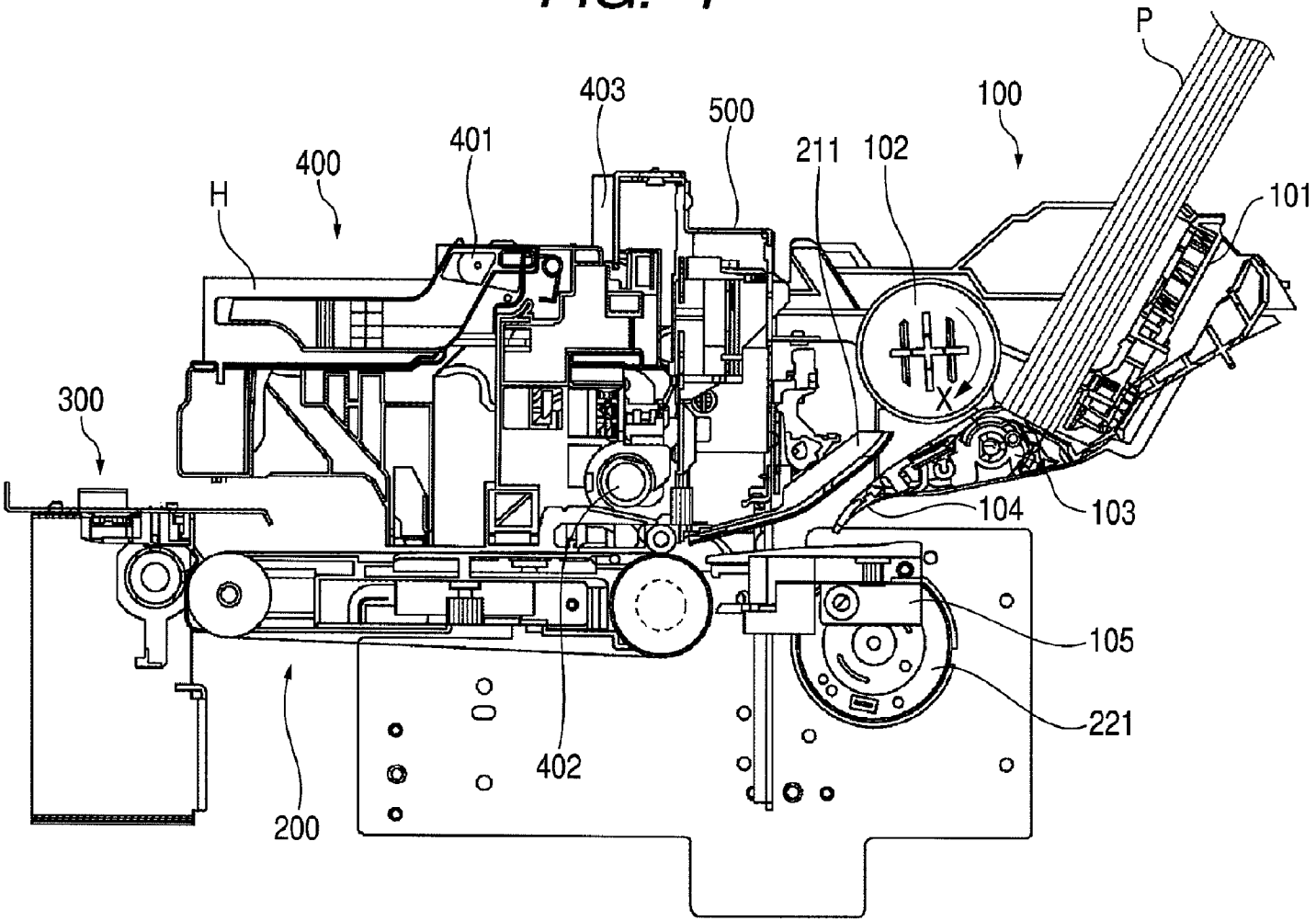
FIG. 1 is a side view of a recording apparatus according to a first embodiment of the present invention.

FIG. 1 shows a side view of a recording apparatus according to a first embodiment of the present invention. The recording apparatus 1 according to the first embodiment includes a paper feed section 100 for feeding a recording sheet P and a conveying section 200 for conveying the recording sheet P fed from the paper feed section 100 in the recording area. Moreover, the recording apparatus 1 includes a paper delivery section 300 disposed on the downstream side of the conveying section 200 in the recording sheet conveying direction for delivering the recording sheet where recording is completed to the outside of the apparatus. The recording apparatus 1 further includes a movable carriage section 400 which is equipped with a recording head H for recording on the recording sheet P.

A paper feed motor, which is not shown, drives the paper feed section 100. Upon driving of the paper feed motor, a pressure plate 101 on which recording sheets are stacked rises and thereby the top recording sheet P abuts against a paper feed roller 102. The paper feed roller 102 then rotates in the X direction shown in FIG. 1 to pick up the recording sheet P. One recording sheet is then separated by the paper feed roller 102 and a separation roller 103 which abuts against the paper feed roller 102. The separated recording sheet P is guided by paper guides 104 and 105 and a pinching roller holder 211 and conveyed up to a conveying section 200.

Figure 2:
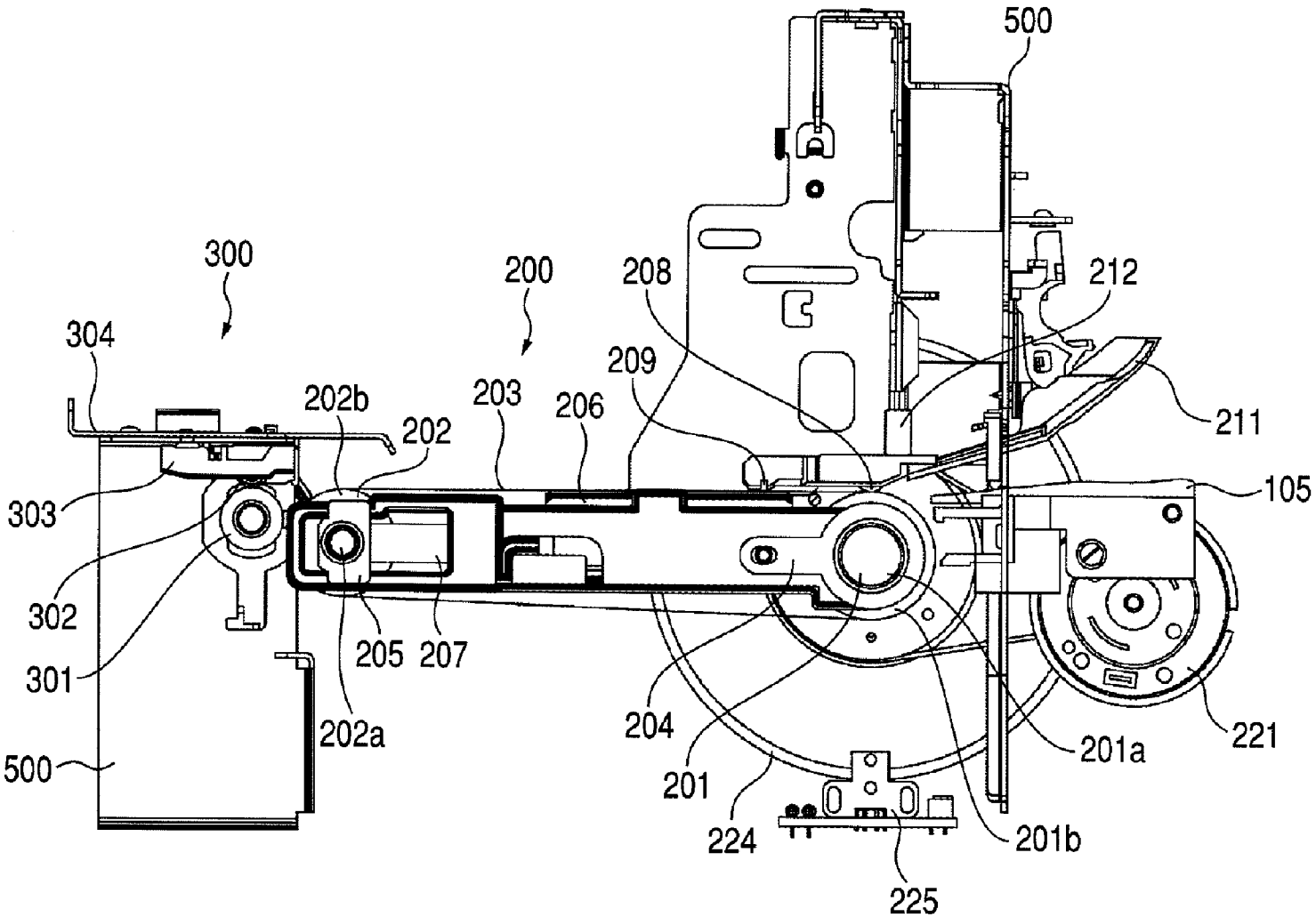
FIG. 2 is a side view illustrating a conveying section and a paper delivery section of the recording apparatus according to the first embodiment of the present invention.
Figure 3:
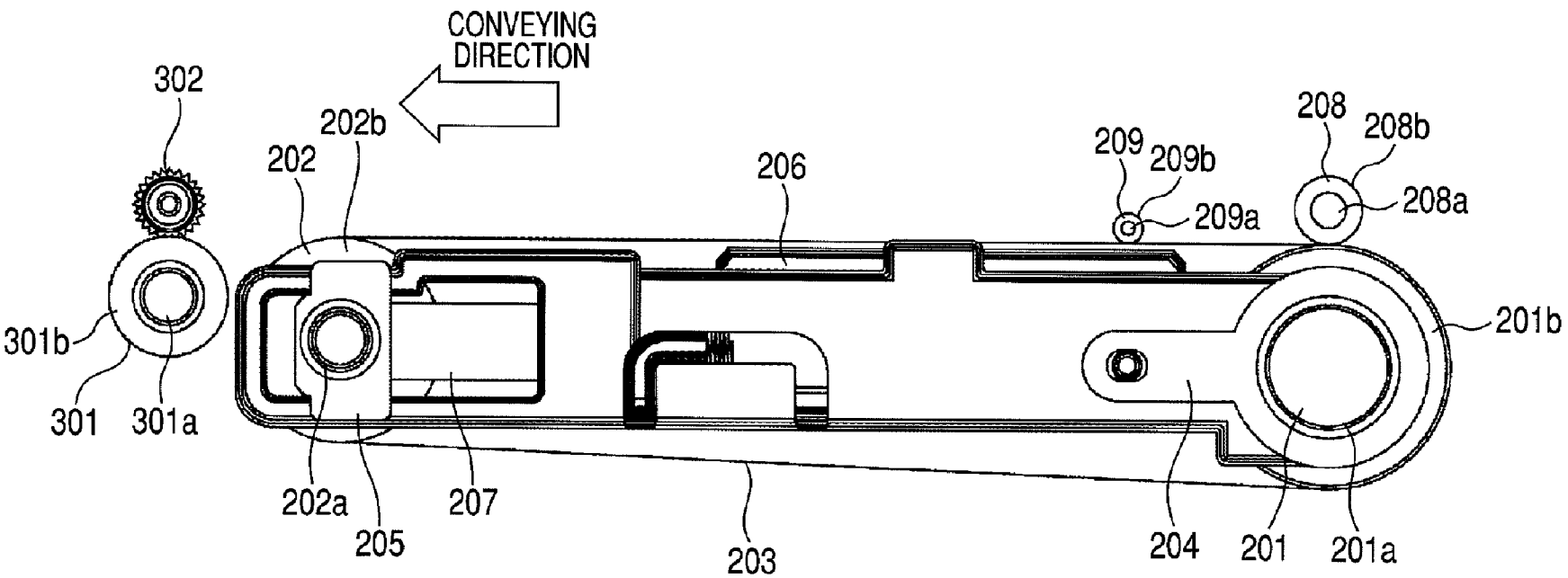
FIG. 3 is a side view illustrating a belt conveying section of the recording apparatus according to the first embodiment of the present invention.

FIG. 2 shows a side view illustrating a conveying section and a paper delivery section of the recording apparatus according to the first embodiment of the present invention. FIG. 3 shows a side view illustrating a belt conveying section of the recording apparatus according to the first embodiment of the present invention. The side views in FIGS. 2 and 3 each show the recording apparatus viewed from the right side thereof. In the conveying section 200, a conveying belt 203 is wound around between a driving roller 201 and a driven roller 202. The driving roller 201 is supported by a platen 206 via a driving roller bearing 204. The driven roller 202 is supported by the platen 206 via a driven roller bearing 205. Moreover, the driven roller 202 is biased in a direction of applying a tension to the conveying belt 203 by means of a driven roller spring 207 which is a compression spring. The driving roller 201 is biased by means of a pinching roller 208 via the conveying belt 203. The recording sheet P is able to be conveyed with being pinched between the conveying belt 203 wound around the driving roller 201 and the pinching roller 208. A discharging roller 209 abuts against the conveying belt 203 on the downstream side of the pinching roller 208 in the recording sheet conveying direction. The discharging roller 209 is rotatable following the movement of the conveying belt 203. The discharging roller 209 is capable of electrically discharging the surface of the conveying belt 203 or the recording surface of the recording sheet P.

The driving roller 201 has a first roller 201*a* made of a metallic material and a second roller 201*b* made of an elastic material such as rubber along the axial direction. The first roller 201*a* is formed into a small-diameter roller relative to the second roller 201*b*. As a rubber material for forming the second roller 201*b*, for example, conductive rubber based on EPDM (ethylene-propylene-diene terpolymer) is used and the rubber hardness is preferably on the order of 50° to 90°. Alternatively, materials having a relatively high friction coefficient may be used such that the second roller 201*b* is formed of a metal pipe, which is coated with conductive EPDM on the outer peripheral surface or with conductive urethane elastomer or conductive urethane coating applied on the outer peripheral surface.

The driven roller 202 is made of a metallic material, having a first roller 202*a* and a second roller 202*b* along the axial direction. The first roller 202*a* is formed into a small-diameter roller relative to the second roller 202*b*. The second roller 202*b* may be formed of a pipe for weight saving purposes.

The conveying belt 203 has a two-layer structure with an insulating layer on its front face and a conductive layer on its rear face. Alternatively, it is possible to use a single-layer belt having a high resistance and a high dielectric constant.

The pinching roller 208 and the discharging roller 209 are supported by the pinching roller holder 211 made of a conductive material. The pinching roller holder 211 is attached to a chassis 500 made of a metallic material. The chassis 500 is grounded, thereby enabling the pinching roller 208 and the discharging roller 209 to be grounded. The pinching roller 208 has a first roller 208*a* made of a metallic material and a second roller 208*b* made of an elastic material such as rubber along the axial direction. The first roller 208*a* is formed into a small-diameter roller relative to the second roller 208*b*. As a rubber material for forming the second roller 208*b*, for example, conductive rubber based on EPDM is used and the rubber hardness is preferably on the order of 50° to 90°. The discharging roller 209 is made of a metallic material, having a first roller 209*a* and a second roller 209*b* along the axial direction. Moreover, the first roller 209*a* is formed into a small-diameter roller relative to the second roller 209*b*. A conductive plastic material may be employed for both of the pinching roller 208 and the discharging roller 209. The pinching roller 208 and the discharging roller 209 are pressed to the conveying belt 203 by means of a pinching roller spring 212 and a discharging roller spring, which is not shown, respectively.

The platen 206 has a plurality of ribs in the recording sheet conveying direction and in a direction intersecting with the conveying direction. The conveying belt 203 is guided by the ribs while rotating. The ribs define a distance between the conveying belt 203 and the recording head H.

Figure 4:
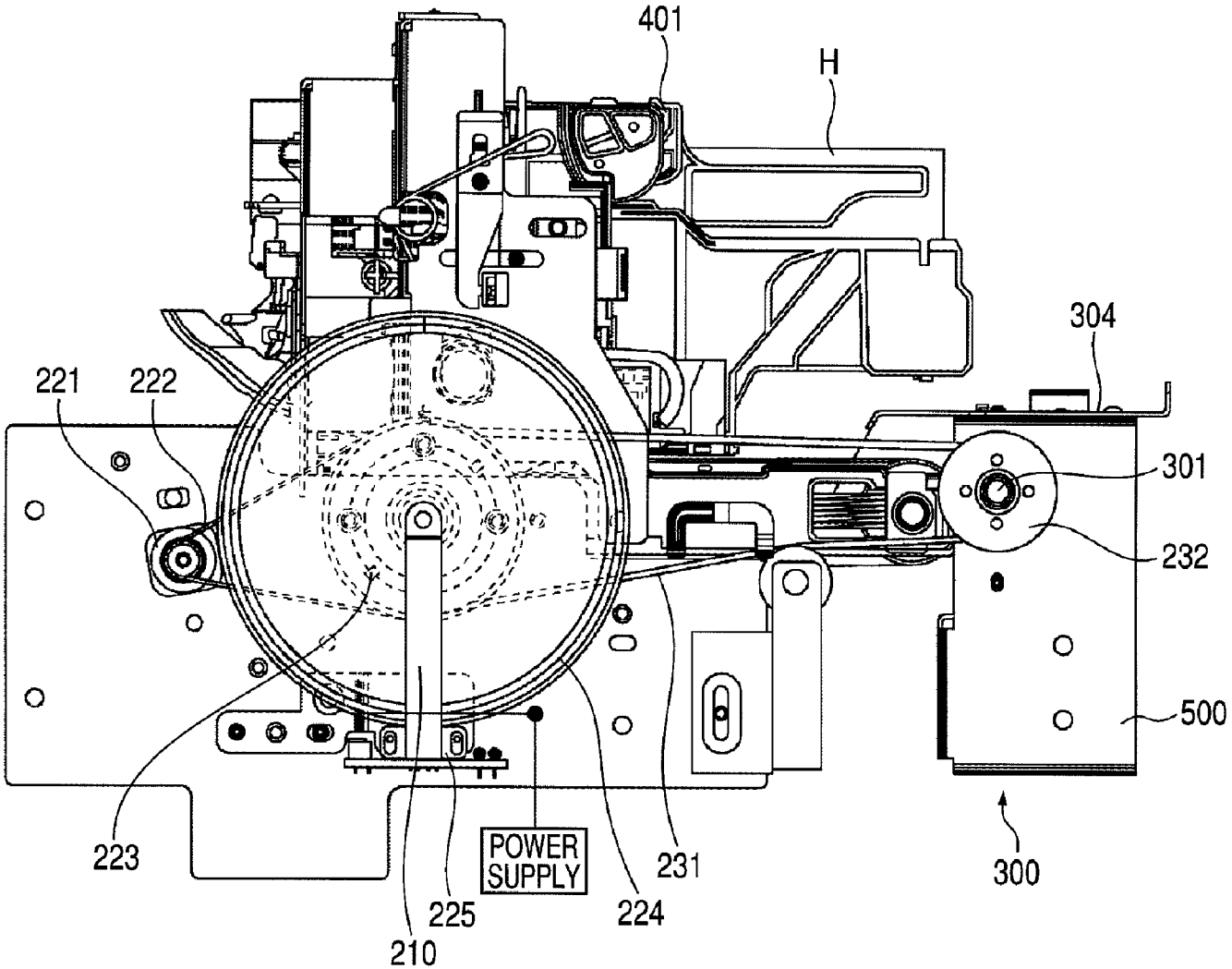
FIG. 4 is a side view illustrating a drive section of the conveying section and that of the paper delivery section of the recording apparatus according to the first embodiment of the present invention.

FIG. 4 shows a side view illustrating a drive section of the conveying section and that of the paper delivery section of the recording apparatus according to the first embodiment of the present invention. The side view in FIG. 4 shows the recording apparatus viewed from the left side thereof. In FIG. 4, a conveyance motor 221 is used to drive the driving roller 201. The drive of the conveyance motor 221 is transmitted to the driving roller 201 via a driving belt 222 and a driving roller pulley 223. A rotary encoder 224 is attached to the shaft of the driving roller 201. The rotary encoder 224 is used to detect an amount of rotation of the driving roller 201. A slit is printed on the rotary encoder 224 and an encoder sensor 225 reads the slit. Moreover, a metal plate 210 connected to a power supply abuts against the side surface of the first roller 201*a* of the driving roller 201. A voltage is applied to the driving roller 201 via the metal plate 210.

The paper delivery section 300 has a paper delivery roller 301, a spur 302 which is driven by the paper delivery roller 301 to rotate, and a spur holder 303 which rotatably supports the spur 302. The paper delivery section 300 has a spur stay 304 which is attached to the chassis 500 to support the spur holder 303.

The paper delivery roller 301 has a first roller 301*a* made of a metallic material and a second roller 301*b* made of an elastic material such as rubber along the axial direction. The first roller 301*a* is formed into a small-diameter roller relative to the second roller 301*b*. As a rubber material for forming the second roller 301*b*, for example, conductive rubber based on EPDM is used and the rubber hardness is preferably on the order of 50° to 90°. Alternatively, materials having a relatively high friction coefficient may be used such that the second roller 301*b* is coated with urethane elastomer or urethane coating applied on the surface. Further, coating containing ceramic particles may be applied to the surface of the second roller 301*b*. A paper delivery roller pulley 232 is provided on the shaft of the paper delivery roller 301. In addition, a paper delivery driving belt 231 is wound around between the driving roller pulley 223 and the paper delivery roller pulley 232. The paper delivery roller 301 is driven via the paper delivery driving belt 231 and the paper delivery roller pulley 232.

Figure 5:
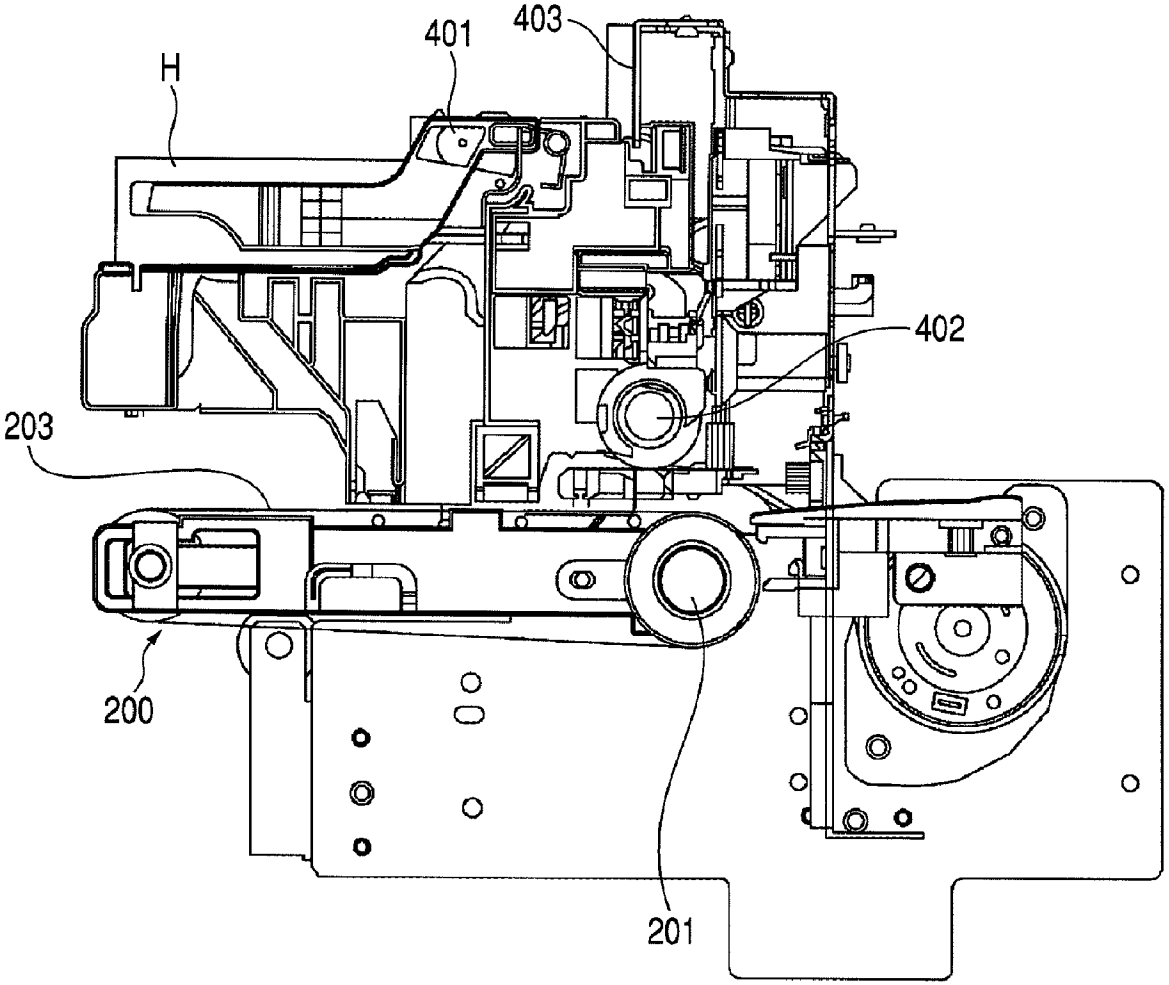
FIG. 5 is a side view illustrating a carriage section of the recording apparatus according to the first embodiment of the present invention.

FIG. 5 shows a side view illustrating the carriage section 400 of the recording apparatus according to the first embodiment of the present invention. The side view in FIG. 5 shows the recording apparatus viewed from the right side thereof. The carriage section 400 moves the recording head H to record on the recording sheet P. The carriage section 400 includes a carriage 401 for mounting the recording head H and a driving member of the carriage 401. The carriage 401 is guided by a guide shaft 402 and a guide rail 403 which are attached to the chassis 500 when moving in the width direction of the recording sheet P.

The recording apparatus 1 moves the carriage 401 according to a recording signal to record on the recording sheet P. Moreover, the recording apparatus 1 intermittently conveys the recording sheet P by rotating the driving roller 201 to move the conveying belt 203. The recording apparatus 1 records on the entire recording sheet P by repeating these operations. Upon completion of the recording, the recording sheet P is pinched between the paper delivery roller 301 and the spur 302 and conveyed so as to be delivered to the outside of the recording apparatus.

Figure 6:
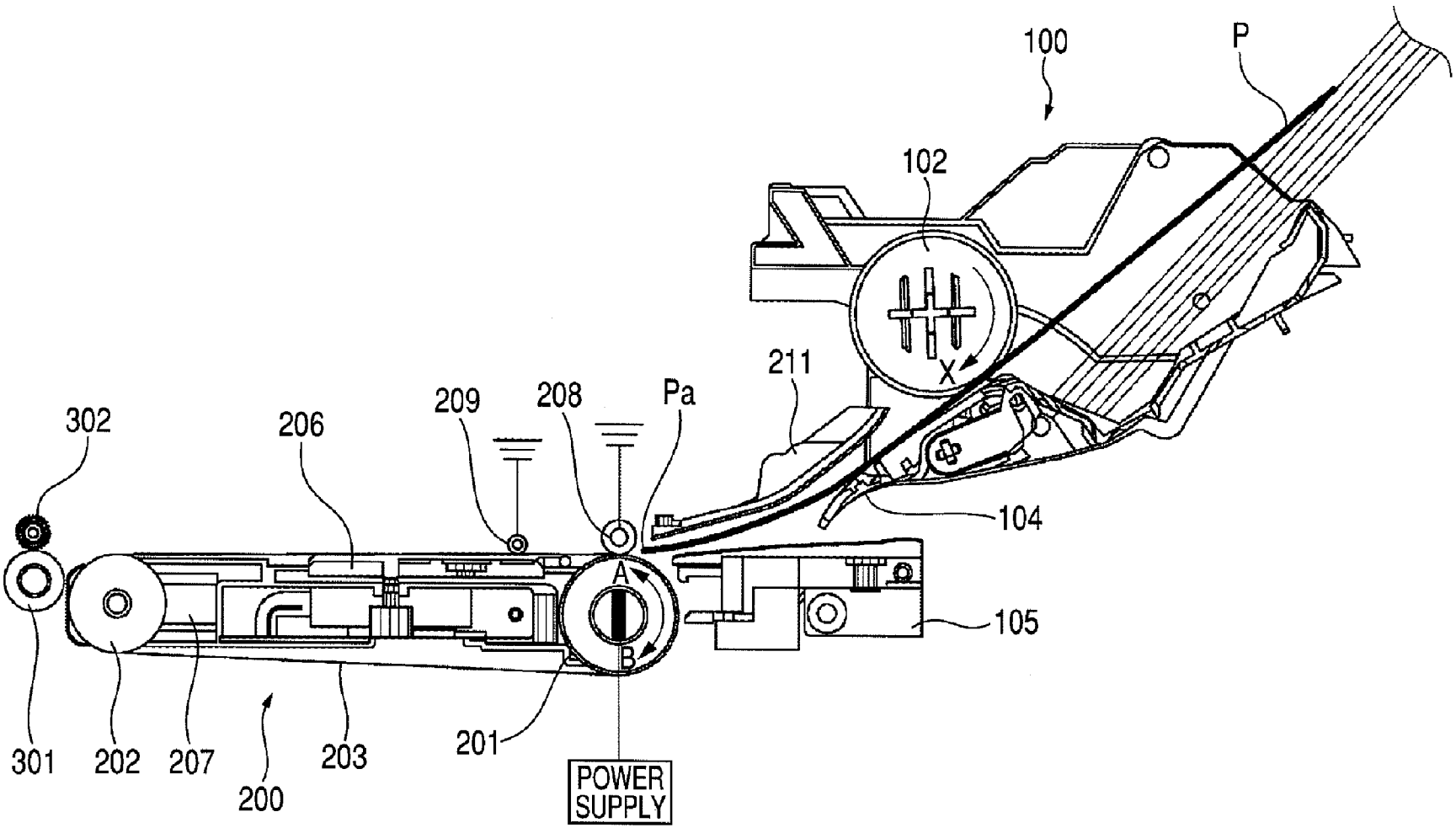
FIG. 6 is a side view illustrating an operation of correcting skew feeding of the recording apparatus according to the first embodiment of the present invention.

FIG. 6 shows a side view illustrating an operation of correcting skew feeding of the recording apparatus according to the first embodiment of the present invention. In FIG. 6, a paper feed motor, which is not shown, is driven to rotate the paper feed roller 102 in the X direction indicated by an arrow in the figure, thereby feeding one of the recording sheets P stacked on the pressure plate 101. The fed recording sheet P is fed toward the pinching section formed by the driving roller 201 and the pinching roller 208 via the conveying belt 203. During this operation, the driving roller 201 is standing still. The front edge of the recording sheet P strikes against the pinching section formed by the driving roller 201 and the pinching roller 208. Thereafter, an additional rotation of the paper feed roller 102 aligns the front edge of the recording sheet P along the pinching section. In other words, the skew feeding of the recording sheet P is corrected and thus the recording sheet P is registered.

After the correction of the skew feeding of the recording sheet P, the recording apparatus 1 applies a voltage to the driving roller 201 via the metal plate 210. Thereby, electric charges appear on the surface of the conveying belt 203 and thereby the conveying belt 203 charges with electricity. This enables the conveying belt 203 to absorb the front edge of the recording sheet P. While the applied voltage is variable according to the type of the recording sheet, temperature, humidity and other operating environments, generally about 2 kV is applied. In this embodiment, the driving roller for driving the conveying belt is used to generate electric charges on the conveying belt and to perform registration for correcting the skew feeding of the fed recording sheet. Moreover, the skew feeding of the recording sheet is corrected before generating the electric charges on the conveying belt, thereby enabling a reliable correction of the skew feeding of the recording sheet.

After the correction of the skew feeding of the recording sheet and the generation of the electric charges on the conveying belt 203, the recording apparatus 1 rotates the driving roller 201 to convey the recording sheet up to the recording start position and then performs recording by means of the recording head H. The conveying belt 203 conveys the recording sheet in an area from a portion in contact with the driving roller 201 to a portion in contact with the driven roller 202. The driving roller 201 is located at the upstream end of the conveying portion of the conveying belt 203. This configuration prevents a delay in the start of moving the recording sheet P, in response to the start of driving the driving roller 201, due to the expansion and contraction of the belt or flip-flop thereof when the conveyance of the recording sheet P is started after the correction of the skew feeding of the recording sheet P.

Second Embodiment

Figure 7:
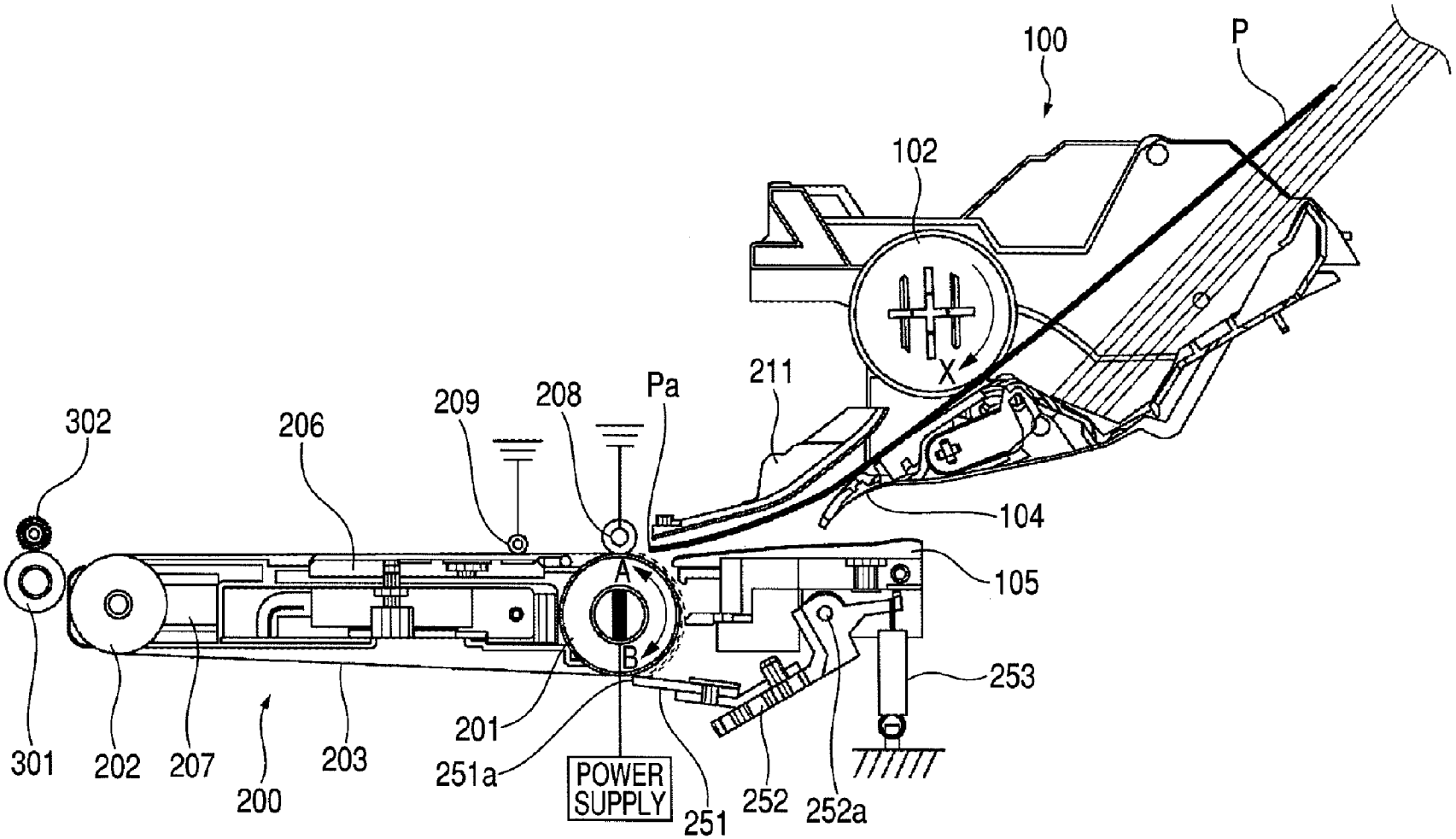
FIG. 7 is a side view of a recording apparatus according to a second embodiment of the present invention.

FIG. 7 shows a side view of a recording apparatus according to a second embodiment of the present invention. In the second embodiment, the recording apparatus 1 has a wiper 251 for removing dirt and foreign substances attached to the surface of the conveying belt 203.

On the other hand, the wiper 251 friction-slides the surface of the conveying belt 203. This electrically charges the surface of the conveying belt 203 that has passed through the wiper 251 as indicated by broken lines in FIG. 7. In the case where the front edge of the recording sheet P abuts against the pinching section formed by the driving roller 201 and the pinching roller 208 in a state where the surface of the conveying belt 203 is strongly electrically charged, the recording sheet P could be absorbed by the conveying belt 203. In that case, the skew feeding correction might not be able to be fully performed.

Therefore, in this embodiment, the recording apparatus 1 rotates the driving roller 201 in the opposite direction to the conveying direction of the recording sheet P so that the portion electrically discharged by the discharging roller 209 of the conveying belt 203 comes to the pinching section formed by the driving roller 201 and the pinching roller 208. Thereafter, the front edge of the recording sheet P is set to abut against the pinching section formed by the driving roller 201 and the pinching roller 208. In this embodiment, the recording apparatus 1 is able to reliably correct the skew feeding of the recording sheet by preventing the recording sheet from being absorbed by the conveying belt during the correction of the skew feeding of the recording sheet also in the arrangement with the wiper for friction-sliding the surface of the conveying belt.

Third Embodiment

Figure 8:
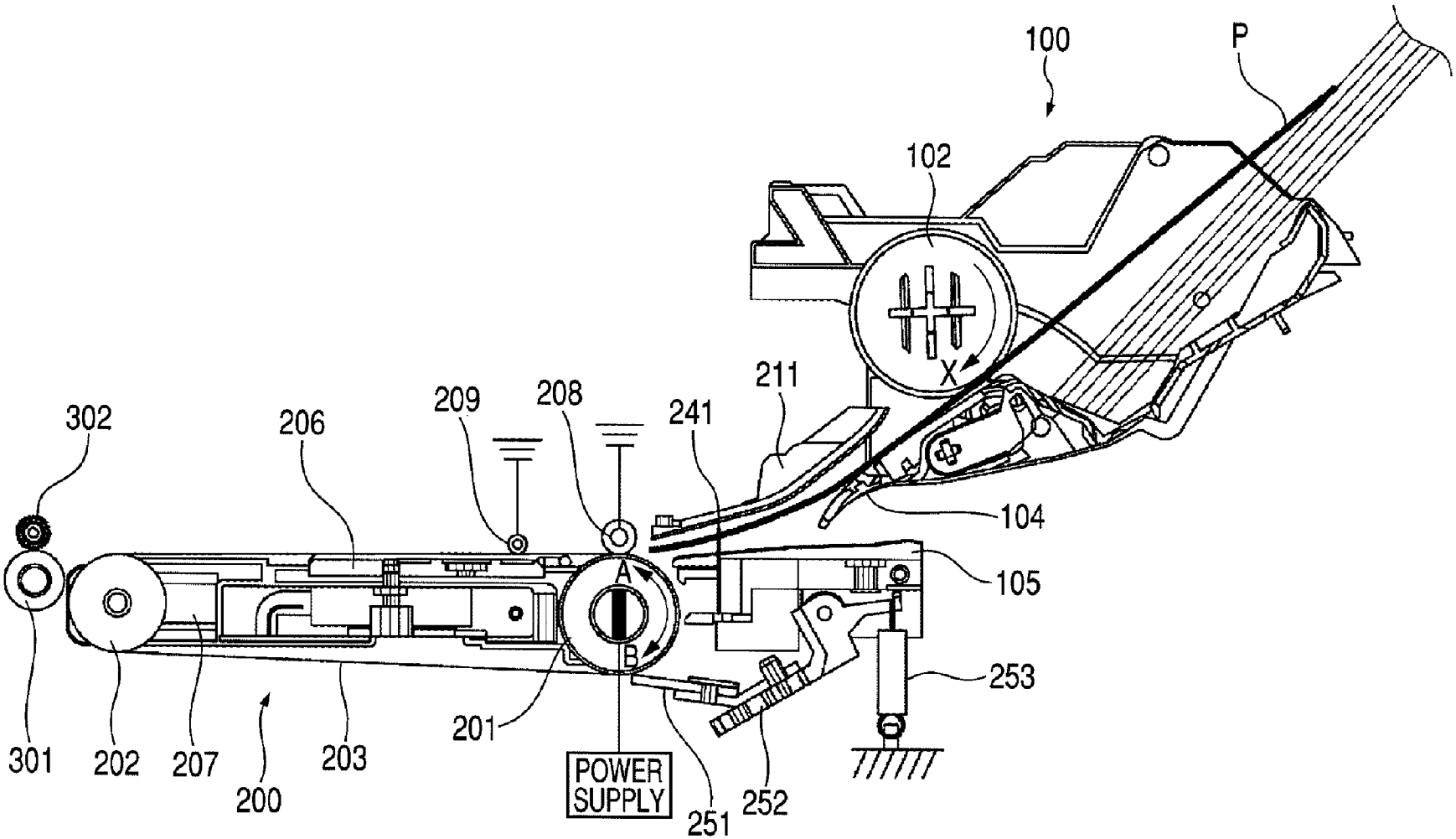
FIG. 8 is a side view of a recording apparatus according to a third embodiment of the present invention.

FIG. 8 shows a side view of a recording apparatus according to a third embodiment of the present invention. The recording apparatus 1 of the third embodiment is provided with a discharge brush in a path for feeding the recording sheet P between the paper feed section and the conveying section.

The recording sheet P fed by the paper feed roller 102 is guided by the paper guides 104 and 105 and the pinching roller holder 211 so as to be conveyed up to the conveying section 200. In this regard, the recording sheet P is electrically charged due to a contact between the recording sheet P and the paper guides 104 and 105. If the front edge of the electrically charged recording sheet P strikes against the pinching section formed by the driving roller 201 and the pinching roller 208, the conveying belt 203 could absorb the recording sheet P. In that case, the skew feeding correction might not be able to be fully performed.

Therefore, the recording apparatus 1 of this embodiment is provided with a discharge brush 241 for discharging the electrically-charged recording sheet P due to abutment with the recording sheet P between the paper feed section 100 and the pinching section formed by the driving roller 201 and the pinching roller 208. According to this arrangement, the recording sheet P has already been electrically discharged when the front edge of the recording sheet P abuts against the pinching section formed by the driving roller 201 and the pinching roller 208, and therefore the conveying belt 203 does not absorb the recording sheet P. This arrangement enables the recording apparatus to reliably correct the skew feeding of the recording sheet. Moreover, the discharge brush 241 may be movably disposed in a position to abut against the fed recording sheet and in a position to be spaced apart from the recording sheet. The discharge brush 241 may move to such a position as to abut against the recording sheet P during feeding of the recording sheet P in order to electrically discharge the recording sheet P and then move to such a position as to be spaced apart from the recording sheet P after the skew feeding of the recording sheet P is corrected and the recording sheet P is absorbed by the conveying belt 203.

Fourth Embodiment

In the first to third embodiments, with the driving roller 201 in a stopped state, the recording apparatus 1 corrects the skew feeding of the recording sheet by abutting the front edge of the recording sheet P against the pinching section formed by the driving roller 201 and the pinching roller 208. In the fourth embodiment, the recording apparatus 1 corrects the skew feeding of the recording sheet by abutting the front edge of the recording sheet P against the driving roller 201 rotating in the opposite direction to the recording sheet conveying direction.

The recording sheet P fed by the paper feed roller 102 is fed toward the pinching section formed by the driving roller 201 and the pinching roller 208. The front edge of the recording sheet P is abutted against the pinching section formed by the driving roller 201, which is rotating in the opposite direction (in the direction indicated by an arrow B in FIG. 6) to the recording sheet conveying direction, and the pinching roller 208, which is rotating in the opposite direction following the driving roller 201. Thereafter, the paper feed roller 102 is further rotated, by which the front edge of the recording sheet P is aligned along the pinching section. In other words, the skew feeding of the recording sheet P is corrected and thereby the registration of the recording sheet P is performed.

After the skew feeding correction of the recording sheet P, the recording apparatus 1 applies a voltage to the driving roller 201 via the metal plate 210. Thereby, electric charges appear on the surface of the conveying belt 203, thus enabling the conveying belt 203 to absorb the front edge of the recording sheet P. After the skew feeding correction of the recording sheet P and the electric charge generation on the conveying belt 203, the rotation of the driving roller 201 conveys the recording sheet up to the recording start position and then the recording apparatus 1 performs recording by means of the recording head H.

Fifth Embodiment

Figure 9:
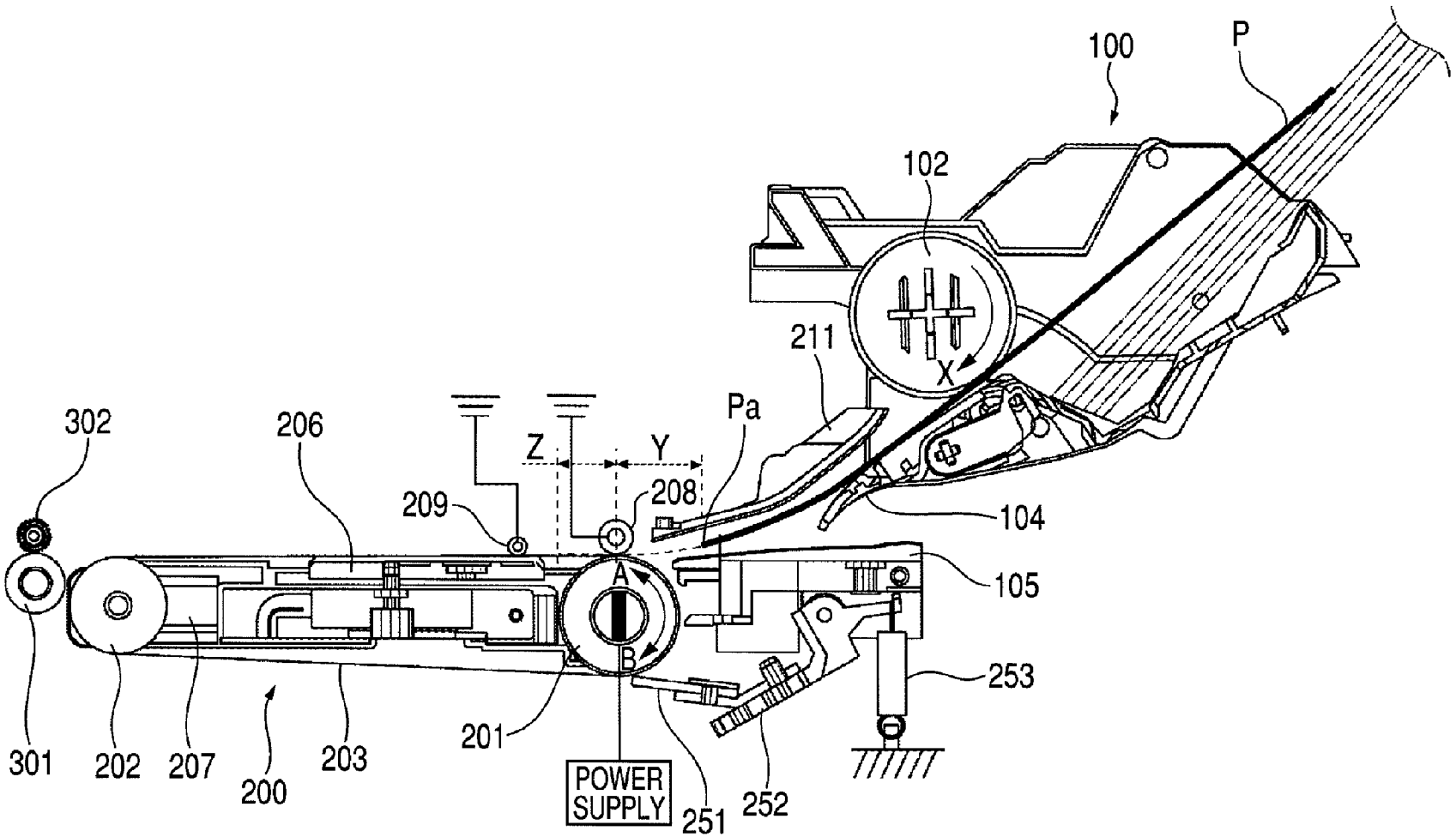
FIG. 9 is a side view of a recording apparatus according to a fifth embodiment of the present invention.

FIG. 9 shows a side view of a recording apparatus according to a fifth embodiment of the present invention. In the fifth embodiment, the front edge of the recording sheet P is once passed through the pinching section formed by the driving roller 201 and the pinching roller 208 and then the rotation of the driving roller 201 is reversed to correct the skew feeding of the recording sheet.

The recording sheet P fed by the paper feed roller 102 is fed toward the pinching section formed by the driving roller 201 and the pinching roller 208. Upon detecting that the front edge of the recording sheet P reaches the position, which is upstream from and a distance Y apart from the pinching section, by means of a sensor or the like, the recording apparatus 1 starts the driving of the conveyance motor 221 so that the driving roller 201 rotates in the recording sheet conveying direction. The Y value is determined according to the type and size of the recording sheet P and the operating environments. While the driving roller 201 is rotating in the direction indicated by an arrow A in FIG. 9, the recording apparatus 1 applies a voltage to the driving roller 201 via the metal plate 210. Thereby, electric charges appear on the surface of the conveying belt 203.

When the front edge of the recording sheet P reaches the pinching section formed by the driving roller 201 and the pinching roller 208, the recording sheet P is absorbed by the conveying belt 203 and passes through the pinching section to be conveyed to a recording area. Upon detecting that the front edge of the recording sheet P reaches the position a distance Z apart from the pinching section by means of a sensor or the like, the recording apparatus 1 stops the driving of the conveyance motor 221 and a paper feed motor, which is not shown. The Z value is determined according to the type and size of the recording sheet P and the operating environments, too.

Thereafter, the recording apparatus 1 rotates the driving roller 201 in the opposite direction to the recording sheet conveying direction by reversing the direction of rotation of the conveyance motor 221 with the paper feed motor stopped. During this rotation, any voltage is not applied to the driving roller 201. Thereby, the recording sheet P is conveyed in the opposite direction and the front edge of the recording sheet P disengages from the pinching section formed by the driving roller 201 and the pinching roller 208. In this state, the rear part of the recording sheet P is pressed by the paper feed roller 102 which is stopped and therefore the front edge of the recording sheet P is aligned along the pinching section formed by the driving roller 201 and the pinching roller 208. In other words, the skew feeding of the recording sheet P is corrected and thereby the registration of the recording sheet P is performed.

After the skew feeding correction of the recording sheet P, the recording apparatus 1 applies a voltage to the driving roller 201 via the metal plate 210. Thereby, electric charges appear on the surface of the conveying belt 203, thus enabling the conveying belt 203 to absorb the front edge of the recording sheet P. After the skew feeding correction of the recording sheet P and the electric charge generation on the conveying belt 203, the recording apparatus 1 rotates the driving roller 201 to convey the recording sheet P up to the recording start position and performs recording by means of the recording head H.

Sixth Embodiment

In the first to fifth embodiments, the recording apparatus 1 applies a voltage to the driving roller 201 to generate electric charges on the surface of the conveying belt 203 and to ground the pinching roller 208. In a sixth embodiment, the recording apparatus 1 applies a voltage to the pinching roller 208 to generate electric charges on the surface of the conveying belt 203 and to ground the driving roller 201.

Figure 10:
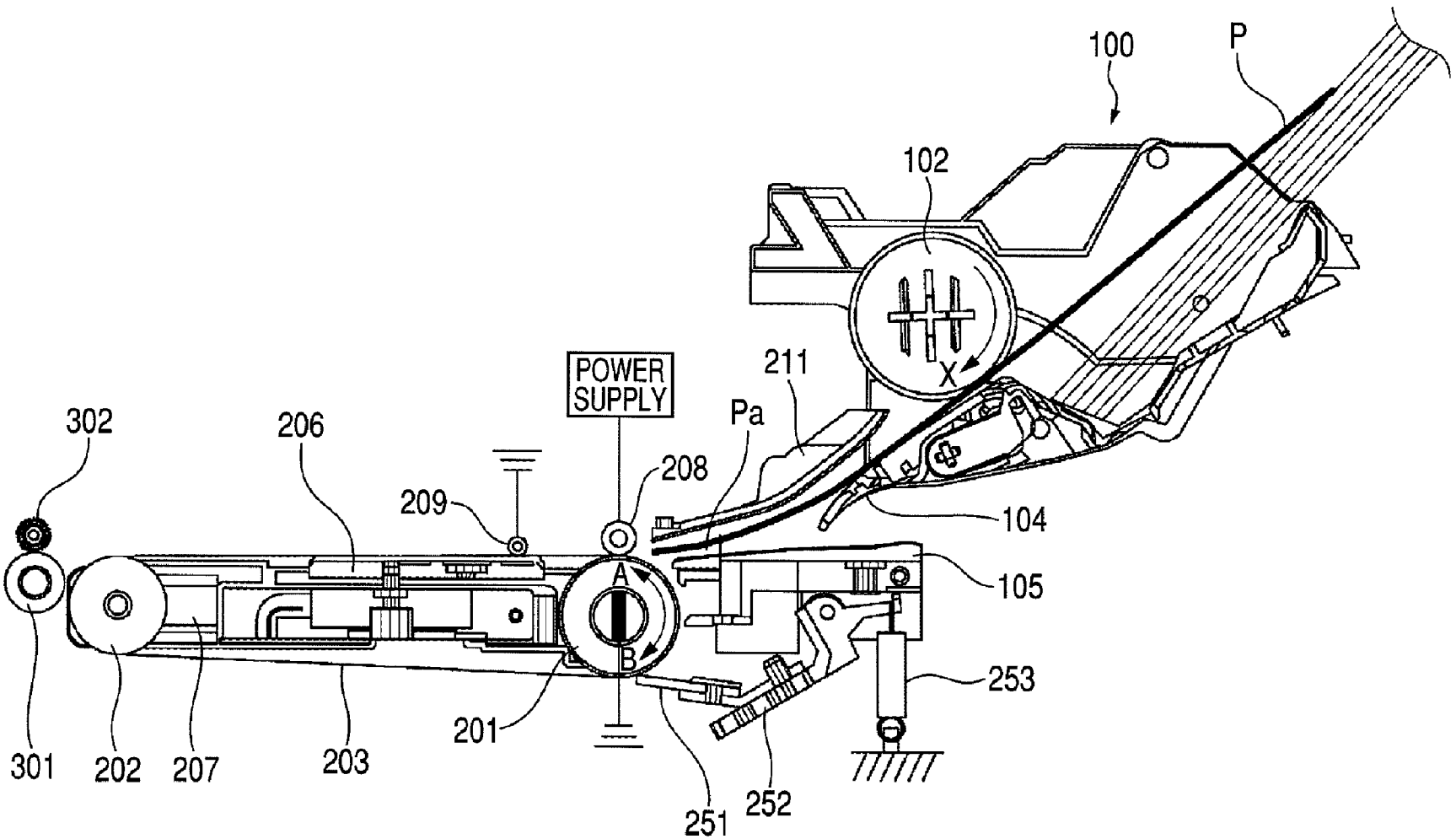
FIG. 10 is a side view of a recording apparatus according to a sixth embodiment of the present invention.
Figure 11:
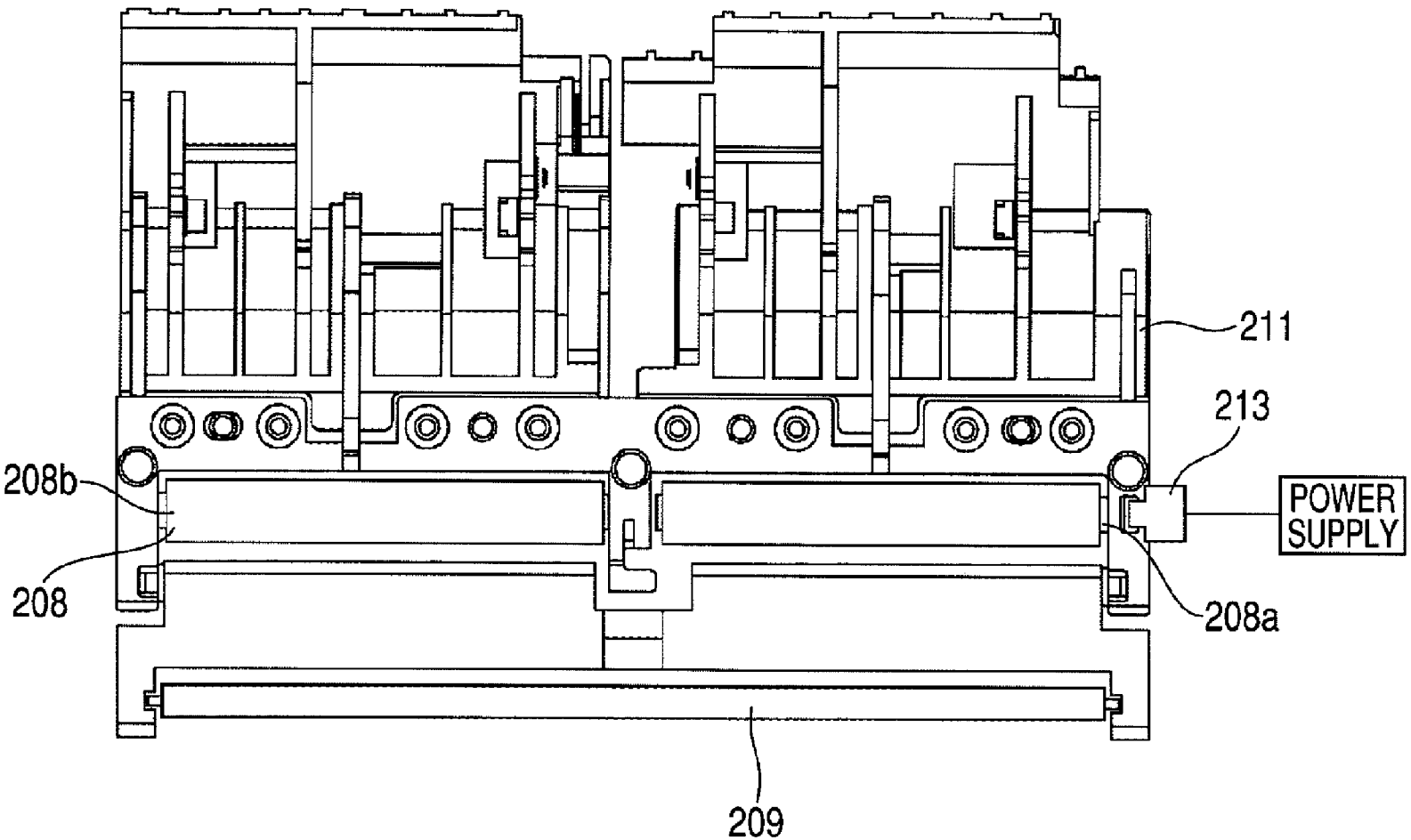
FIG. 11 is a plan view illustrating the configuration of a pinching roller holder according to the sixth embodiment of the present invention.

FIG. 10 shows a side view of a recording apparatus according to the sixth embodiment of the present invention. FIG. 11 shows a plan view illustrating the configuration of a pinching roller holder according to the sixth embodiment of the present invention.

In FIG. 11, a non-conductive material is used to form the pinching roller holder 211 for rotatably supporting the pinching roller 208 in this embodiment. A metal plate 213, which is connected to the power supply, abuts on the side surface of the first roller 208*a* of the pinching roller 208. A voltage is applied to the pinching roller 208 via the metal plate 213.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-122393, filed May 8, 2008, which is hereby incorporated by reference in its entirety.

What is claimed is:

1. A recording apparatus comprising:

a feed roller for feeding a recording sheet;

a conveying belt for absorbing and conveying the recording sheet;

a driving roller for driving said conveying belt wound around said driving roller;

a power supply for electrically charging said conveying belt by application of a voltage; and a pinching roller abutting said driving roller via said conveying belt, wherein the recording apparatus performs recording on the recording sheet absorbed by said conveying belt, wherein said driving roller stops rotation such that the recording sheet fed by said feed roller abuts a nip between said conveying belt and said pinching roller, thus performing skew correction, and wherein said power supply does not apply the voltage to electrically charge said conveying belt until the skew correction is complete.

2. The recording apparatus according to claim 1, wherein said pinching roller is grounded.

3. The recording apparatus according to claim 1, wherein said driving roller and said pinching roller stop rotation such that the recording sheet fed by said feed roller abuts a nip between said conveying belt and said pinching roller.

4. The recording apparatus according to claim 3, further comprising a discharging roller which abuts said conveying belt and is disposed downstream of said pinching roller in a recording sheet conveying direction.

5. The recording apparatus according to claim 4, further comprising a wiper which abuts said conveying belt to remove foreign substances attached to said conveying belt.

6. The recording apparatus according to claim 5, wherein said driving roller is moved in the direction opposite to the recording sheet conveying direction such that a part of said conveying belt electrically discharged by said discharging roller comes back to the nip between said conveying belt and said pinching roller.

7. The recording apparatus according to claim 1, wherein said driving roller and said pinching roller rotate in a reverse direction after the recording sheet reaches the nip between said conveying belt and said pinching roller.

8. The recording apparatus according to claim 1, wherein said driving roller rotates in the reverse direction to convey the recording sheet in the direction opposite to the recording sheet conveying direction after the recording sheet passes the nip between said conveying belt and said pinching roller.

9. The recording apparatus according to claim 1, further comprising a discharge brush for discharging an electrically charged recording sheet, said discharge brush being disposed between said paper feed roller and said driving roller.

10. The recording apparatus according to claim 9, wherein said discharge brush is movably disposed in a position to abut the fed recording sheet or a position spaced apart from the recording sheet.

11. A recording apparatus comprising:

a feed roller for feeding a recording sheet;

a conveying belt for absorbing and conveying the recording sheet;

a driving roller for driving the conveying belt wound around said driving roller;

a pinching roller abutting said driving roller via said conveying belt; and a power supply for applying a voltage to said pinching roller, wherein the recording apparatus performs recording on the recording sheet absorbed by said conveying belt;

wherein said driving roller stops rotation such that the recording sheet fed by said feed roller abuts a nip between said conveying belt and said pinching roller, thus performing skew correction, and wherein said power supply does not apply the voltage to said pinching roller to electrically charge said conveying belt until the skew correction is complete.

12. A recording apparatus comprising:

a feed roller for feeding a recording sheet;

a conveying belt for conveying the recording sheet;

a driving roller for driving said conveying belt wound around said driving roller;

a pinching roller abutting said driving roller via said conveying belt, and a power supply for applying a voltage to said pinching roller;

wherein said driving roller stops rotation such that the recording sheet fed by said feed roller abuts a nip between said conveying belt and said pinching roller, thus performing skew correction, and wherein said power supply does not apply the voltage to said pinching roller to electrically charge said conveying belt until the skew correction is complete.

13. The recording apparatus according to claim 12, further comprising a discharging roller which abuts said conveying belt and is disposed downstream of said pinching roller in a recording sheet conveying direction.

14. The recording apparatus according to claim 13, wherein said driving roller is moved in the direction opposite to the recording sheet conveying direction such that a part of said conveying belt electrically discharged by said discharging roller comes back to the nip between said conveying belt and said pinching roller.

* * * * *